US007932647B2

(12) United States Patent
Nakao et al.

(10) Patent No.: US 7,932,647 B2
(45) Date of Patent: Apr. 26, 2011

(54) ELECTROMAGNETIC RECIPROCATING FLUID APPARATUS

(75) Inventors: Haruki Nakao, Tokyo (JP); Kunihiro Yamamoto, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 1022 days.

(21) Appl. No.: 11/390,637

(22) Filed: Mar. 27, 2006

(65) Prior Publication Data

US 2006/0216170 A1 Sep. 28, 2006

(30) Foreign Application Priority Data

Mar. 28, 2005 (JP) ..... 2005-091199

(51) Int. Cl.
*H02K 33/18* (2006.01)
*H02K 35/06* (2006.01)

(52) U.S. Cl. ..... 310/15; 310/181; 417/417

(58) Field of Classification Search ..... 417/416, 417/417; 310/24, 15, 17, 21, 181, 190, 191
See application file for complete search history.

(56) References Cited

U.S. PATENT DOCUMENTS 2,954,917 A * 10/1960 Bayer ..... 417/417
3,542,495 A * 11/1970 Barthalon ..... 417/416
3,947,155 A * 3/1976 Bidol ..... 417/417
4,198,743 A * 4/1980 Stuber ..... 29/596
5,222,878 A * 6/1993 Osada et al. ..... 417/417
6,540,491 B1 4/2003 Tanabe

FOREIGN PATENT DOCUMENTS

EP 0770779 5/1997
JP S57-30984 7/1982
JP 2003-32924 A 1/2003

OTHER PUBLICATIONS

Office Action issued Jun. 18, 2008 in Japanese patent application No. 2005-091199 (with translation).
Combined Search and Examination Report issued in UK on Jun. 23, 2006.

* cited by examiner

*Primary Examiner* — Devon C Kramer
*Assistant Examiner* — Patrick Hamo
(74) *Attorney, Agent, or Firm* — Brinks Hofer Gilson & Lione

(57) ABSTRACT

An electromagnetic reciprocating fluid apparatus includes a magnetic circuit device in which magnetic pole members project inward from an annular magnetic circuit member so as to oppose each other. The magnetic pole members and the annular magnetic circuit member have a uniform thickness. First and second additional annular magnetic circuit members are set on both sides of the annular magnetic circuit member to constitute a part of the magnetic circuit device, thereby minimizing the increase in magnetic reluctance due to magnetic flux concentration at the joints between the magnetic pole members and the annular magnetic circuit member.

9 Claims, 6 Drawing Sheets

Prior Art

Prior Art

Prior Art

Prior Art

ELECTROMAGNETIC RECIPROCATING FLUID APPARATUS

This application claims priority under 35 U.S.C. §119 to Japanese Patent Application No. 2005-091199 filed Mar. 28, 2005, the entire content of which is hereby incorporated by reference.

BACKGROUND

The present invention relates to an electromagnetic reciprocating fluid apparatus, e.g. pumps and compressors, comprising a magnetic circuit device having induction coils and a pair of opposed magnetic poles, wherein magnetic force is intermittently induced between the magnetic poles by intermittently exciting the induction coils so that a magnetic armature is attracted and driven by the magnetic force to reciprocate a piston connected to the magnetic armature.

FIGS. 1 and 2 are schematic views of an electromagnetic reciprocating fluid apparatus used as a pump or a compressor.

As illustrated in the figures, the apparatus comprises an exciting circuit having induction coils 16 and 18 wound around magnetic pole members 10 and 12, respectively, and a half-wave rectifier 20. The apparatus further comprises a piston 24 slidably fitted in a cylinder 22. A magnetic armature 28 is secured to the rod portion of the piston 24. A coil spring 30 urges the piston 24 leftward as viewed in the figures.

When an AC voltage is applied to the exciting circuit, an electric current intermittently flows through the exciting circuit so that the induction coils 16 and 18 are intermittently excited to thereby intermittently induce magnetic force between the magnetic pole members 10 and 12. The magnetic armature 28 is therefore magnetically attracted rightward to drive the piston 24 rightward. When the magnetic force disappears, the piston 24 is driven leftward by the coil spring 30. In this way, the piston 24 is reciprocated. The cylinder 22 is provided with a pair of check valves 32 and 34. The reciprocating motion of the piston 24 causes the check valves 32 and 34 to open and close alternately, thereby allowing a fluid to flow in through a fluid inlet 38 formed in a housing 36 and to flow out through a fluid outlet 40 formed in the housing 36.

FIGS. 3 and 4 show an example of a specific arrangement of the electromagnetic reciprocating fluid apparatus.

The apparatus comprises magnetic pole members 10 and 12, induction coils 16 and 18, a cylinder 22, a piston 24, a magnetic armature 28, a coil spring 30, check valves 32 and 34, and a housing 36 having a fluid inlet 38 and a fluid outlet 40 in the same way as the apparatus shown in FIGS. I and 2. This type of electromagnetic reciprocating fluid apparatus is disclosed, for example, in Japanese Patent Publication No. Sho 57-30984.

FIG. 4 shows the relationship between the magnetic armature 28 and the magnetic pole members 10 and 12. More specifically, the magnetic pole members 10 and 12 are formed from mutually opposing portions projecting from the left and right side sections of a substantially quadrangular magnetic circuit member 41 made of a magnetic material and the induction coils 16 and 18 are respectively wound around the projecting portions. The magnetic pole members 10 and 12 have mutually opposing circular-arc surfaces 10' and 12' which are formed about an axis extending normal to the surface of FIG. 4 and through the center of the space between the magnetic pole members 10 and 12. The magnetic armature 28 extends along the axis and has a circular section.

In the apparatus having the above-described structure, the length of a stroke and the magnitude of a thrust of the piston 24 are determined as a function of the width and thickness or the cross sectional area of the magnetic pole members 10 and 12. In general, the width and thickness of the magnetic circuit member 41 are designed so that the magnetic flux density is substantially uniform throughout the magnetic circuit formed from the magnetic circuit member 41 and the magnetic pole members 10 and 12.

A computer simulation analysis of a magnetic circuit arranged as stated above reveals, however, that there are following problems:

In general, the magnetic circuit member 41 is designed to have the same thickness as that of the magnetic pole members 10 and 12, and the width of the magnetic circuit member 41 is determined according to the thickness. In the magnetic circuit thus arranged, at the comers of the magnetic circuit defined by the inner peripheral surface of the magnetic circuit member 41 and the outer peripheral surfaces of the pole members 10 and 12 intersecting the inner peripheral surface of the magnetic circuit member 41 there is caused concentration of lines of the magnetic force. The magnetic flux concentration increases the magnetic reluctance, causing degradation of the efficiency of the apparatus.

BRIEF SUMMARY

Accordingly, an object of the present invention is to minimize the increase in the magnetic reluctance due to the magnetic flux concentration to thereby prevent degradation of the efficiency of the apparatus.

The present invention provides an electromagnetic reciprocating fluid apparatus including a piston having a piston rod and a magnetic armature secured to the piston rod. The piston is reciprocatable along the longitudinal axis of the piston rod. The apparatus further includes a magnetic circuit device having a pair of magnetic pole members spaced apart from each other in a direction normal to said axis and disposed on the opposite sides of the axis. The magnetic circuit device is intermittently excited to induce magnetic force between the magnetic pole members, thereby magnetically attracting the magnetic armature to drive the piston in the direction of the axis. The magnetic circuit device further includes an annular magnetic circuit member. The magnetic pole members are integrally formed with the annular magnetic circuit member so that the magnetic pole members project from mutually opposing portions of the inner peripheral surface of the annular magnetic circuit member. The magnetic pole members and the annular magnetic circuit member have a uniform thickness in the direction of the axis. The magnetic circuit device further includes a first additional annular magnetic circuit member that is superimposed on one of the opposite sides of the annular magnetic circuit member.

Preferably, the magnetic circuit device further includes a second additional annular magnetic circuit member so that the first and second additional annular magnetic circuit member are superimposed on the opposite sides of the annular magnetic circuit member.

More specifically, the apparatus may be arranged as follows. The apparatus has a housing comprising first and second housing parts. The first and second housing parts may be set so as to hold the annular magnetic circuit member and the first additional annular magnetic circuit member therebetween in the direction of the axis, and the piston is accommodated in the housing.

The arrangement may also be such that the first and second housing parts are set so as to hold the annular magnetic circuit member and the first and second additional annular magnetic circuit members therebetween in the direction of the axis, and the piston is accommodated in the housing.

In the present invention, the first and/or second additional annular magnetic circuit member is superimposed on the annular magnetic circuit member, whereby it is possible to reduce the magnetic flux concentration at the corners of the magnetic circuit which are defined by the inner peripheral surface of the magnetic circuit member and the outer peripheral surfaces of the magnetic pole members intersecting the inner peripheral surface of the annular magnetic circuit member. Consequently, it becomes possible to minimize the increase in magnetic reluctance caused by the magnetic flux concentration and hence possible to improve the efficiency of the apparatus. The first and/or second additional annular magnetic circuit member can be secured by being held between the first and second housing parts in the state of being superimposed on the annular magnetic circuit member. Thus, the additional annular magnetic circuit members can be incorporated easily.

The above and other objects, features and advantages of the present invention will become more apparent from the following description of the preferred embodiments thereof, taken in conjunction with the accompanying drawings.

DETAILED DESCRIPTION OF THE PREFERRED EMBODIMENTS

Figure 5:
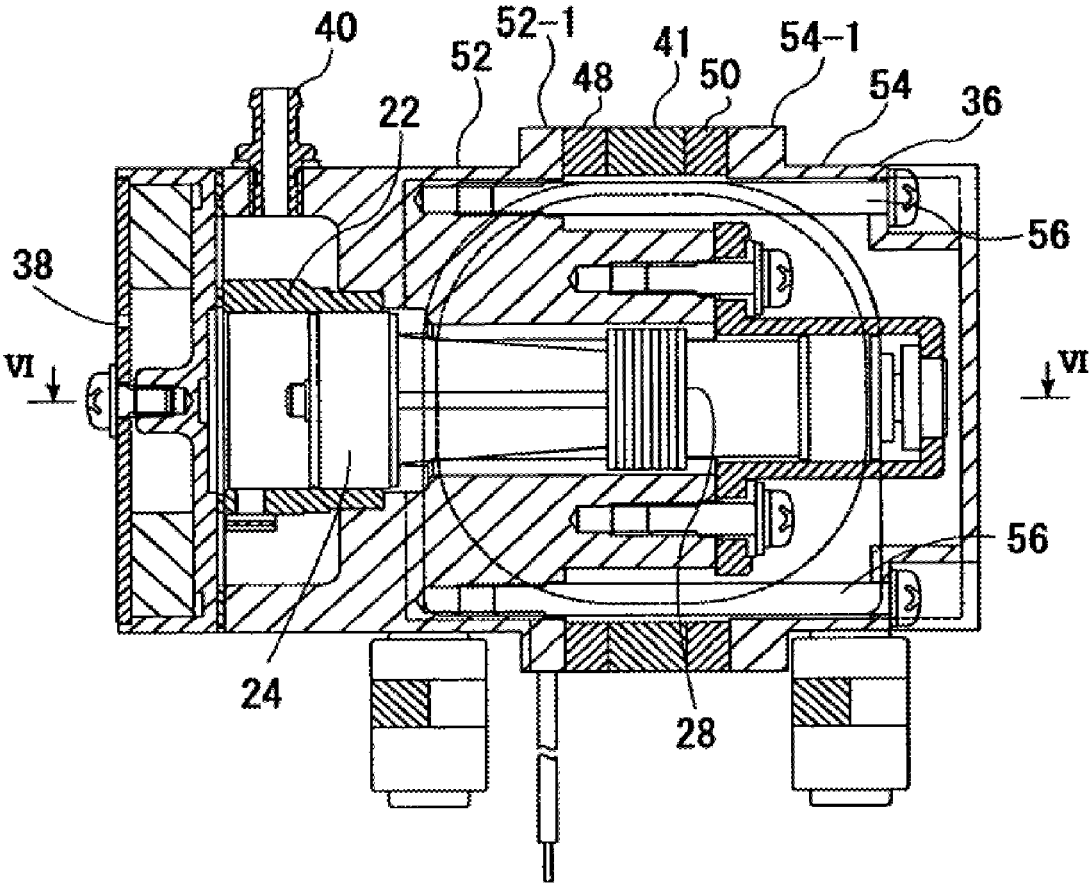
FIG. 5 is a longitudinal sectional side view of an electromagnetic reciprocating fluid apparatus according to the present invention.
Figure 6:
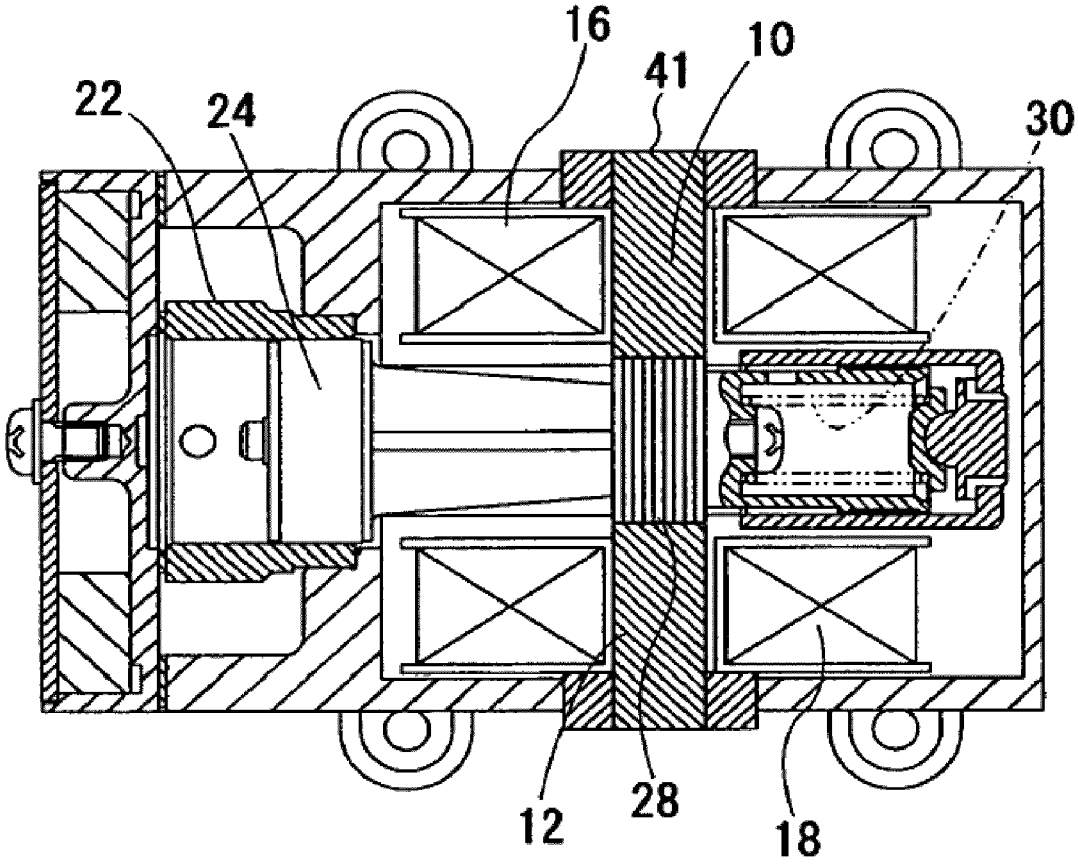
FIG. 6 is a sectional view taken along the line VI-VI in FIG. 5.

An embodiment of the present invention will be described below with reference to the accompanying drawings. FIGS. 5 and 6 show an example of a specific arrangement of an electromagnetic reciprocating fluid apparatus according to the present invention.

Figure 1:
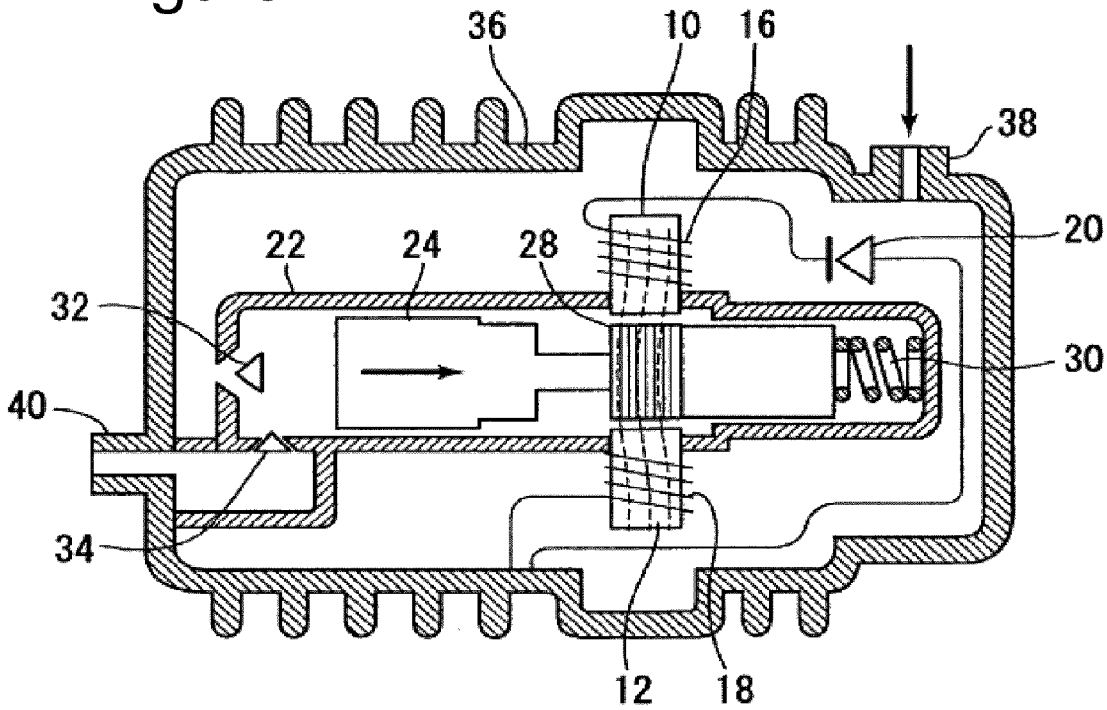
FIG. 1 is a schematic view of an electromagnetic reciprocating fluid apparatus, showing the way in which a fluid is sucked to flow into the apparatus.
Figure 2:
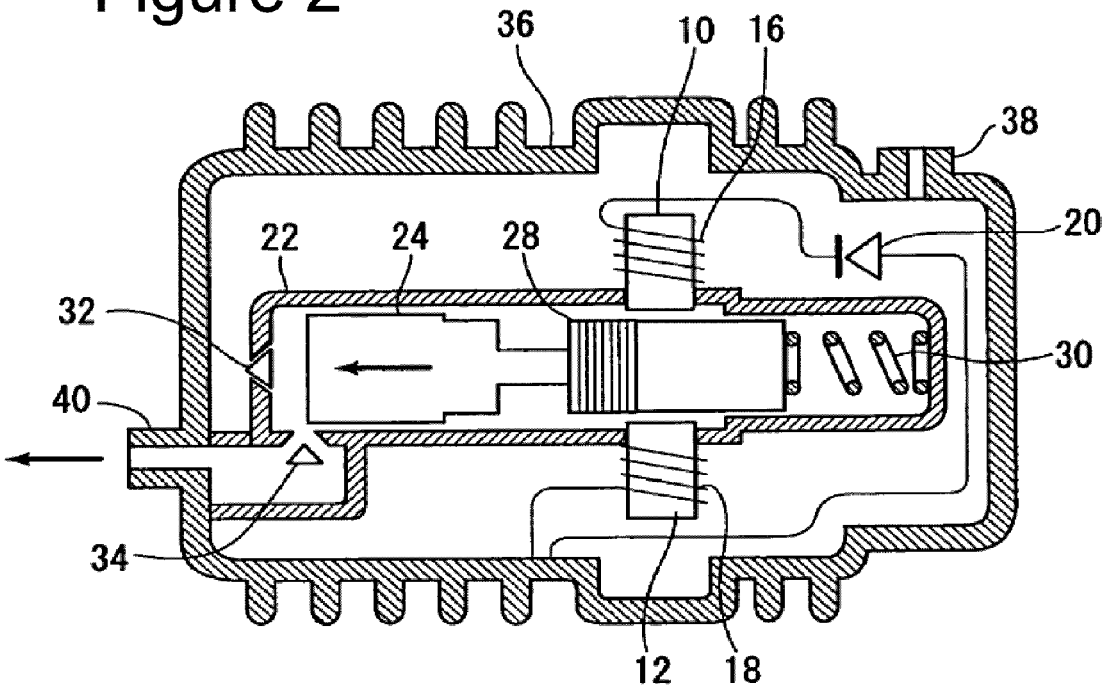
FIG. 2 is a schematic view of the electromagnetic reciprocating fluid apparatus, showing the way in which the fluid is discharged from the apparatus.
Figure 3:
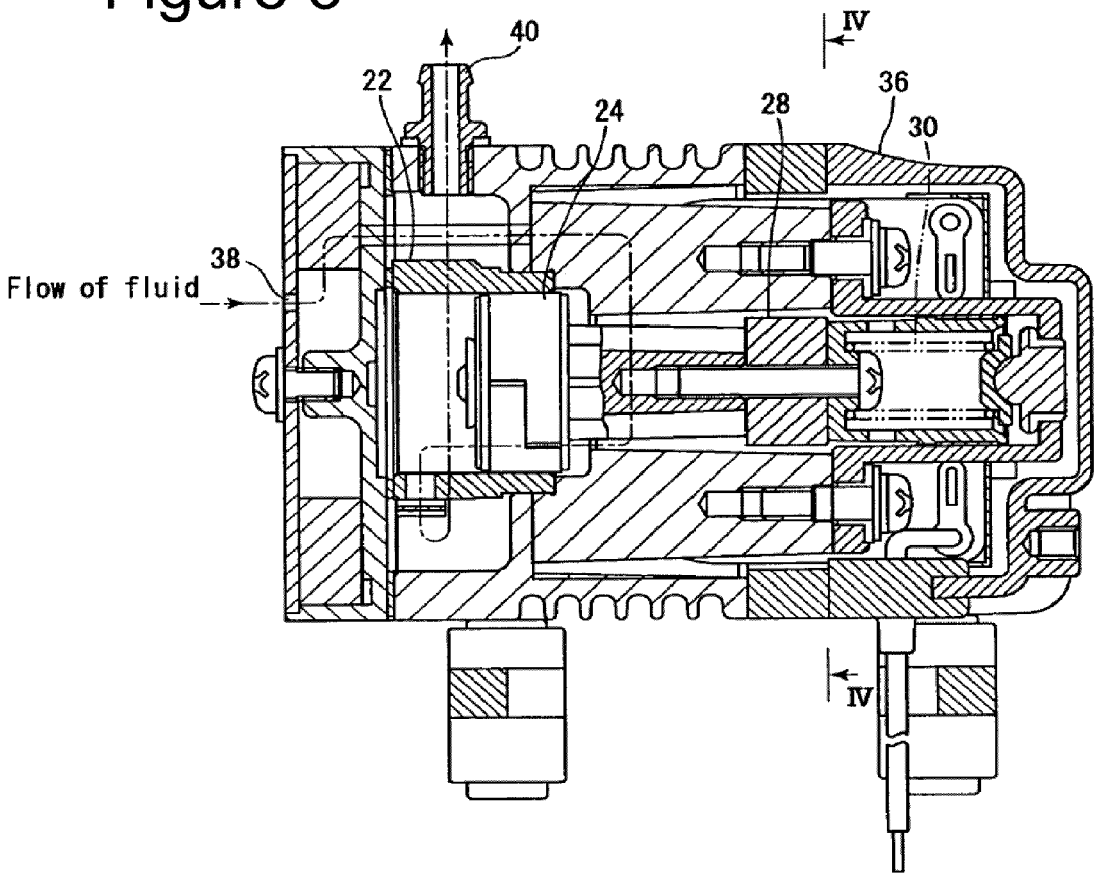
FIG. 3 is a longitudinal sectional side view of a conventional electromagnetic reciprocating fluid apparatus.
Figure 4:
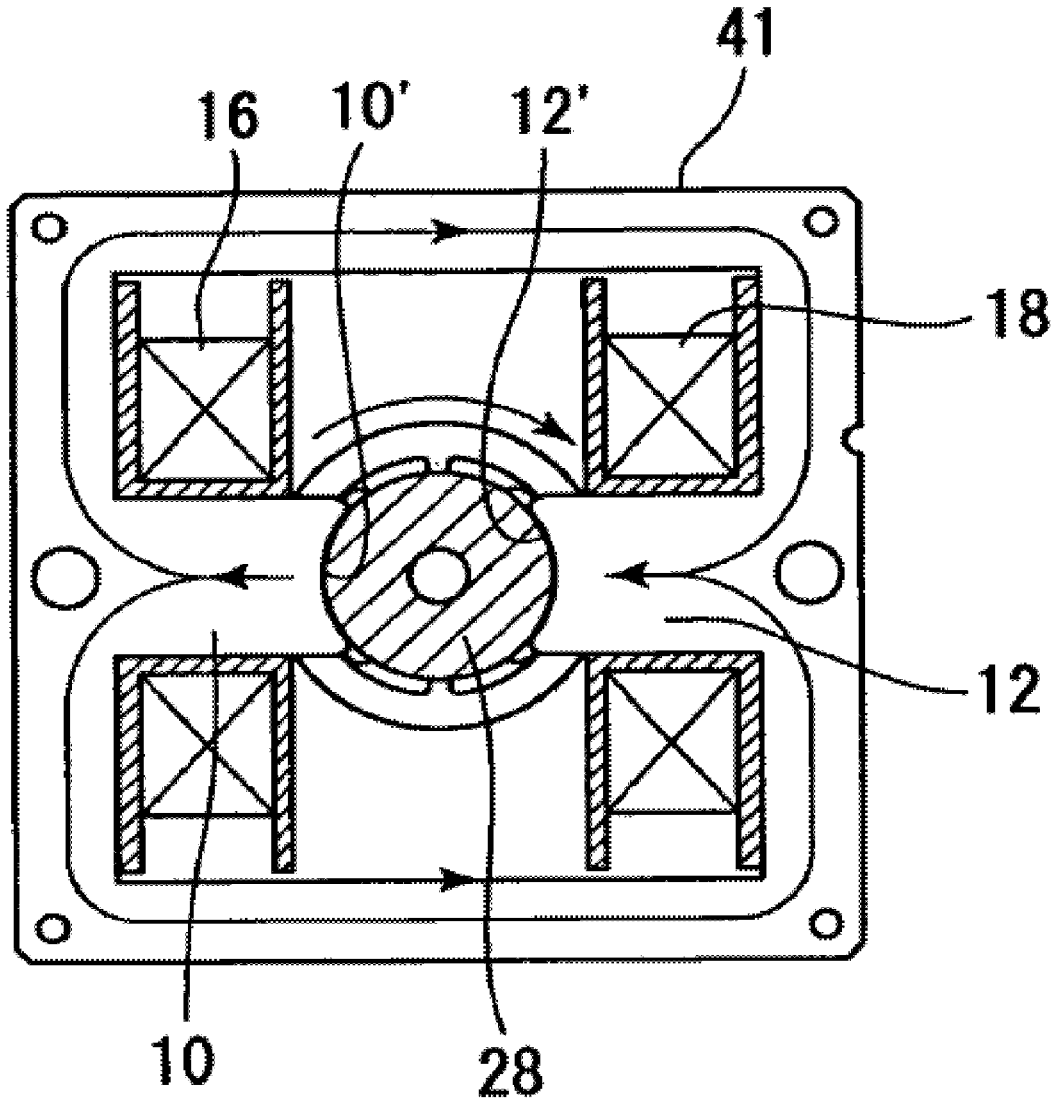
FIG. 4 is a sectional view taken along the line IV-IV in FIG. 3.

As is in the apparatus shown in FIGS. 3 and 4, the apparatus includes magnetic pole members 10 and 12, induction coils 16 and 18, a cylinder 22, a piston 24, a magnetic armature 28, a coil spring 30, a housing 36, a fluid inlet 38, and a fluid outlet 40. The magnetic pole members 10 and 12 extend inward from an annular magnetic circuit member 41 so as to oppose each other. The annular magnetic circuit member 41 is specifically in the shape of a quadrangular ring as is in the apparatus in FIGS. 3 and 4. The magnetic pole members 10 and 12 have the same thickness as that of the annular magnetic circuit member 41 and form a magnetic circuit in cooperation with the annular magnetic circuit member 41.

The electromagnetic reciprocating fluid apparatus according to the present invention is characterized by having first and second additional annular magnetic circuit members 48 and 50 that are in the shape of a quadrangular ring and superimposed on the opposite sides of the magnetic circuit member 41 to form a part of the magnetic circuit.

More specifically, the housing 36 comprises first and second housing parts 52 and 54 having respective annular (quadrangular) flange portions 52-1 and 54-1 conforming in configuration to the first and second additional annular magnetic circuit members 48 and 50. The first additional annular magnetic circuit member 48, the annular magnetic circuit member 41 and the second additional annular magnetic circuit member 50 are set between the flange portions 52-1 and 54-1 and fastened together with bolts 56 extending through the first housing part 52 and screwed into the second housing part 54.

Electric power consumption was measured on two electromagnetic reciprocating fluid apparatus used as linear compressors on condition that the two apparatus had the same air discharge capacity. One of them was provided with the first and second additional annular magnetic circuit members. The other apparatus has no additional annular magnetic circuit member. The result of the measurement revealed that the former apparatus had about 10% reduction in power consumption as compared with the latter apparatus. The reason for the reduction in power consumption is considered to be that the overall magnetic reluctance of the magnetic circuit is reduced by the additional annular magnetic circuit members. It is also considered that the addition of the additional annular magnetic circuit members reduces the increase in magnetic reluctance which, as discussed above, will be otherwise caused due to the magnetic flux concentration caused at the corners of the magnetic circuit defined by the inner peripheral surface of the magnetic circuit member 41 and the outer peripheral surfaces of the pole members 10 and 12 intersecting the inner peripheral surface of the magnetic circuit member 41. In this regard, a computer simulation analysis shows that the apparatus using the additional annular magnetic circuit members 48 and 50 effects an apparent reduction in the magnetic flux concentration at the corners as compared with the apparatus comprising no additional annular magnetic circuit member. The reason for the reduction in the magnetic flux concentration caused at the comers of the magnetic circuit may be considered as follows. When no additional annular magnetic circuit member is used, lines of magnetic force in the magnetic circuit two-dimensionally extend between the annular magnetic circuit member 41 and the pole members through the corners, whereas when the additional annular magnetic circuit members are provided, the lines of magnetic force three-dimensionally extend between the magnetic circuit members and the pole member.

In the above-described computer simulation analysis, a comparative analysis was also made on an apparatus having only one of the additional annular magnetic circuit members 48 and 50. This analysis showed that the apparatus effects an apparent reduction in the magnetic flux concentration as compared with the conventional apparatus.

Although an embodiment of the electromagnetic reciprocating fluid apparatus according to the present invention has been described above, the present invention is not necessarily limited to the described embodiment. For example, the additional annular magnetic circuit members in the foregoing embodiment are shown as discrete members separate from the annular magnetic circuit member, but they may be formed integrally with the annular magnetic circuit member.

Although the present invention has been described in terms of specific embodiments, it is anticipated that alternations and modifications thereof will no doubt become apparent to those skilled in the art. It is therefore intended that the following claims be interpreted as covering all such alternations and modifications as fall within the true sprit and scope of the invention.

The invention claimed is:

1. An electromagnetic reciprocating fluid apparatus comprising:

a piston having a piston rod and a magnetic armature secured to the piston rod, the piston being reciprocatable along a longitudinal axis of the piston rod; and a magnetic circuit device having a pair of magnetic pole members spaced apart from each other in a direction normal to the axis and disposed on opposite sides of the axis, the magnetic circuit device being intermittently excited to induce magnetic force between the magnetic pole members, thereby magnetically attracting the magnetic armature to drive the piston in the direction of the axis;

wherein the magnetic circuit device further comprises:

an annular magnetic circuit member having opposite side surfaces in the direction of the axis, wherein the magnetic pole members are integrally formed with the annular magnetic circuit member so that the magnetic pole members project from mutually opposing portions of an inner peripheral surface of the annular magnetic circuit member, the magnetic pole members and the annular magnetic circuit member having a uniform thickness in the direction of the axis, further wherein the annular magnet circuit member is configured to surround the axis of the piston rod; and a first additional annular magnetic circuit member superimposed on one of the opposite side surfaces of the annular magnetic circuit member and configured to reduce a magnetic flux concentration near an intersection of the inner peripheral surface of the annular magnetic circuit member and the outer peripheral surface of the pole members.

2. The electromagnetic reciprocating fluid apparatus according to claim 1, wherein the magnetic circuit device further comprises:

a second additional annular magnetic circuit member, the first and second additional annular magnetic circuit members being superimposed on the opposite side surfaces of the annular magnetic circuit member.

3. The electromagnetic reciprocating fluid apparatus according to claim 1, further comprising:

a housing including first and second housing parts;

wherein the first and second housing parts are set so as to hold the annular magnetic circuit member and first additional annular magnetic circuit member therebetween in the direction of the axis.

4. The electromagnetic reciprocating fluid apparatus according to claim 2, further comprising:

a housing including first and second housing parts;

wherein the first and second housing parts are set so as to hold the annular magnetic circuit member and first and second additional annular magnetic circuit members therebetween in the direction of the axis.

5. An electromagnetic reciprocating fluid apparatus comprising:

a piston having a piston rod and a magnetic armature secured to the piston rod, the piston being reciprocatable along a longitudinal axis of the piston rod; and a magnetic circuit device having a pair of magnetic pole members spaced apart from each other in a direction normal to the axis and disposed on opposite sides of the axis, the magnetic circuit device being intermittently excited to induce magnetic force between the magnetic pole members, thereby magnetically attracting the magnetic armature to drive the piston in the direction of the axis;

wherein the magnetic circuit device further comprises:

an annular magnetic circuit member having opposite side surfaces in the direction of the axis, wherein the magnetic pole members are integrally formed with the annular magnetic circuit member so that the magnetic pole members project from mutually opposing portions of an inner peripheral surface of the annular magnetic circuit member, the magnetic pole members and the annular magnetic circuit member having a uniform thickness in the direction of the axis, further wherein the annular magnet circuit member is configured to surround the axis of the piston rod; and a first additional annular magnetic circuit member superimposed on one of the opposite side surfaces of the annular magnetic circuit member and configured to reduce a magnetic flux concentration at corners of the magnetic circuit.

6. The electromagnetic reciprocating fluid apparatus according to claim 5, wherein the magnetic circuit device further comprises:

a second additional annular magnetic circuit member, the first and second additional annular magnetic circuit members being superimposed on the opposite side surfaces of the annular magnetic circuit member.

7. The electromagnetic reciprocating fluid apparatus according to claim 6, further comprising:

a housing including first and second housing parts;

wherein the first and second housing parts are set so as to hold the annular magnetic circuit member and first and second additional annular magnetic circuit members therebetween in the direction of the axis.

8. The electromagnetic reciprocating fluid apparatus according to claim 5, further comprising:

a housing including first and second housing parts;

wherein the first and second housing parts are set so as to hold the annular magnetic circuit member and first additional annular magnetic circuit member therebetween in the direction of the axis.

9. The electromagnetic reciprocating fluid apparatus according to claim 5, wherein the corners of the magnetic circuit comprise an intersection of the inner peripheral surface of the annular magnetic circuit member and the outer peripheral surface of the pole members.

* * * * *